US007427122B2

(12) United States Patent
Nakashima

(10) Patent No.: US 7,427,122 B2
(45) Date of Patent: Sep. 23, 2008

(54) PRINTER MAINTENANCE APPARATUS

(75) Inventor: Atsuhisa Nakashima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 161 days.

(21) Appl. No.: 10/809,442

(22) Filed: Mar. 26, 2004

(65) Prior Publication Data

US 2004/0246296 A1 Dec. 9, 2004

(30) Foreign Application Priority Data

Mar. 27, 2003 (JP) ..... 2003-088718

(51) Int. Cl.
*B41J 2/165* (2006.01)

(52) U.S. Cl. ..... 347/33; 347/29

(58) Field of Classification Search ..... 347/22, 347/29, 33, 37, 42, 32
See application file for complete search history.

(56) References Cited

U.S. PATENT DOCUMENTS 5,097,276 A * 3/1992 Midorikawa ..... 347/32
5,394,178 A * 2/1995 Grange ..... 347/32
5,980,018 A * 11/1999 Taylor et al. ..... 347/31
6,293,648 B1 9/2001 Anderson
2002/0044168 A1 4/2002 Hashi et al.

FOREIGN PATENT DOCUMENTS

EP 1 018 432 A1 7/2000
JP A 2002-120386 4/2002

* cited by examiner

*Primary Examiner*—Stephen D. Meier
*Assistant Examiner*—Geoffrey Mruk
(74) *Attorney, Agent, or Firm*—Oliff & Berridge, PLC

(57) ABSTRACT

A printer maintenance apparatus, includes: a mounting base movable forward and backward between a maintenance position and a retraction position; a wiping mechanism mounted on the mounting base and including a wiper base and a wiper; and a capping mechanism mounted on the mounting base including a cap base and a cap. The cap base moves toward the nozzle surface to move the cap to cover the nozzle surface when the mounting base is at the maintenance position. The cap base moves retractably from the nozzle surface when the mounting base moves from the maintenance position. The wiper base moves toward the nozzle surface to bring the wiper into contact with the nozzle surface when the mounting base is at the maintenance position. The wiper base keeps the wiper in contact with the nozzle surface while the mounting base moves backward from the maintenance position.

18 Claims, 7 Drawing Sheets

PRINTER MAINTENANCE APPARATUS

BACKGROUND OF THE INVENTION

1. Field of the Invention

The present invention relates to a printer maintenance apparatus for wiping and capping the nozzle surface of a print head for ejecting ink droplets from a plurality of nozzles for printing.

2. Background Art

In the related art, as disclosed in JP-A-2002-120386, a recovery processing unit body of a printer mounted with a cap or a wiper is inserted to the Lower side of a print head so as to perform wiping or capping the nozzle surface.

At that time, a guide pin provided in the recovery processing unit body is engaged with a cam groove formed in a guide plate. Thus, in accordance with the shape of the cam groove, the recovery processing unit body is inserted to the lower side of the print head while the recovery processing unit body is moved up toward the nozzle surface so as to perform wiping or capping.

SUMMARY OF THE INVENTION

In such a related-art method, however, the recovery processing unit body is moved up toward the nozzle surface to thereby bring the wiper into contact with the nozzle surface halfway during the process of inserting the recovery processing unit body to the lower side of the print head in accordance with the shape of the cam groove. Then, the recovery processing unit body is further inserted to the lower side of the print head so as to clean the nozzle surface with the wiper. After that, the nozzle surface is covered with the cap, and recovery operation to eject ink from nozzles is performed.

Then, the recovery processing unit body is retreated from the lower side of the print head in the state where the recovery processing unit body has been moved down to leave the nozzle surface. Accordingly, after the recovery operation is performed, the recovery processing unit body is retreated directly without cleaning the nozzle surface with the wiper. Ink and the like may adhere to the nozzle surface during the recovery operation. It is therefore preferable to clean the nozzle surface immediately after the recovery operation. However, since both the forward/backward motion and the up/down motion of the recovery processing unit body depend on the cam groove, there is a problem that the structure of the cam groove is so complicated that the degree of freedom during operation is low. When the wiper or the cap is intended to move up/down independently of the recovery processing unit body in order to increase the degree of freedom, another drive source such as a solenoid is required. Thus, there is a problem that the unit becomes complicated.

A printer maintenance apparatus is disclosed herein, which can carry out wiping or capping at proper timing with a simple structure.

The invention may provide a printer maintenance apparatus for maintaining a printer having a print head, wherein the print head includes a nozzle surface in which a plurality of nozzles are formed, for ejecting ink droplets onto fed printing medium for printing. The apparatus includes: a mounting base that is movable forward and backward between a maintenance position and a retraction position, the maintenance position in which the mounting base is opposed to the nozzle surface and the retraction position in which the mounting base is retracted from the print head; a wiping mechanism being mounted on the mounting base and including a wiper base supported on the mounting base movably toward the nozzle surface and a wiper attached to the wiper base; and a capping mechanism being mounted on the mounting base and including a cap base supported on the mounting base movably toward the nozzle surface and a cap attached to the cap base. The cap base moves toward the nozzle surface to move the cap to cover the nozzle surface when the mounting base is at the maintenance position. The cap base moves retractably from the nozzle surface when the mounting base moves from the maintenance position toward the retraction position. The wiper base moves toward the nozzle surface to bring the wiper into contact with the nozzle surface when the mounting base is at the maintenance position. The wiper base keeps the wiper in contact with the nozzle surface while the mounting base moves backward from the maintenance position toward the retraction position.

The invention may provide a printer including: a print head including a nozzle surface that ejects ink droplets onto fed printing medium; a mounting base that is movable forward and backward between a maintenance position and a retraction position, the maintenance position in which the mounting base is opposed to the nozzle surface and the retraction position in which the mounting base is retracted from the print head; a wiping mechanism being mounted on the mounting base and including a wiper base supported on the mounting base movably toward the nozzle surface and a wiper attached to the wiper base; and a capping mechanism being mounted on the mounting base and including a cap base supported on the mounting base movably toward the nozzle surface and a cap attached to the cap base; wherein the cap base moves toward the nozzle surface to move the cap to cover the nozzle surface when the mounting base is at the maintenance position; the cap base moves retractably from the nozzle surface when the mounting base moves from the maintenance position toward the retraction position; the wiper base moves toward the nozzle surface to bring the wiper into contact with the nozzle surface when the mounting base is at the maintenance position; and the wiper base keeps the wiper in contact with the nozzle surface while the mounting base moves backward from the maintenance position toward the retraction position.

BRIEF DESCRIPTION OF THE DRAWINGS

The present invention may be more readily described with reference to the accompanying drawings.

DETAILED DESCRIPTION OF THE PREFERRED EMBODIMENTS

Embodiments of the invention will be described below in detail with reference to the drawings.

Figure 1:
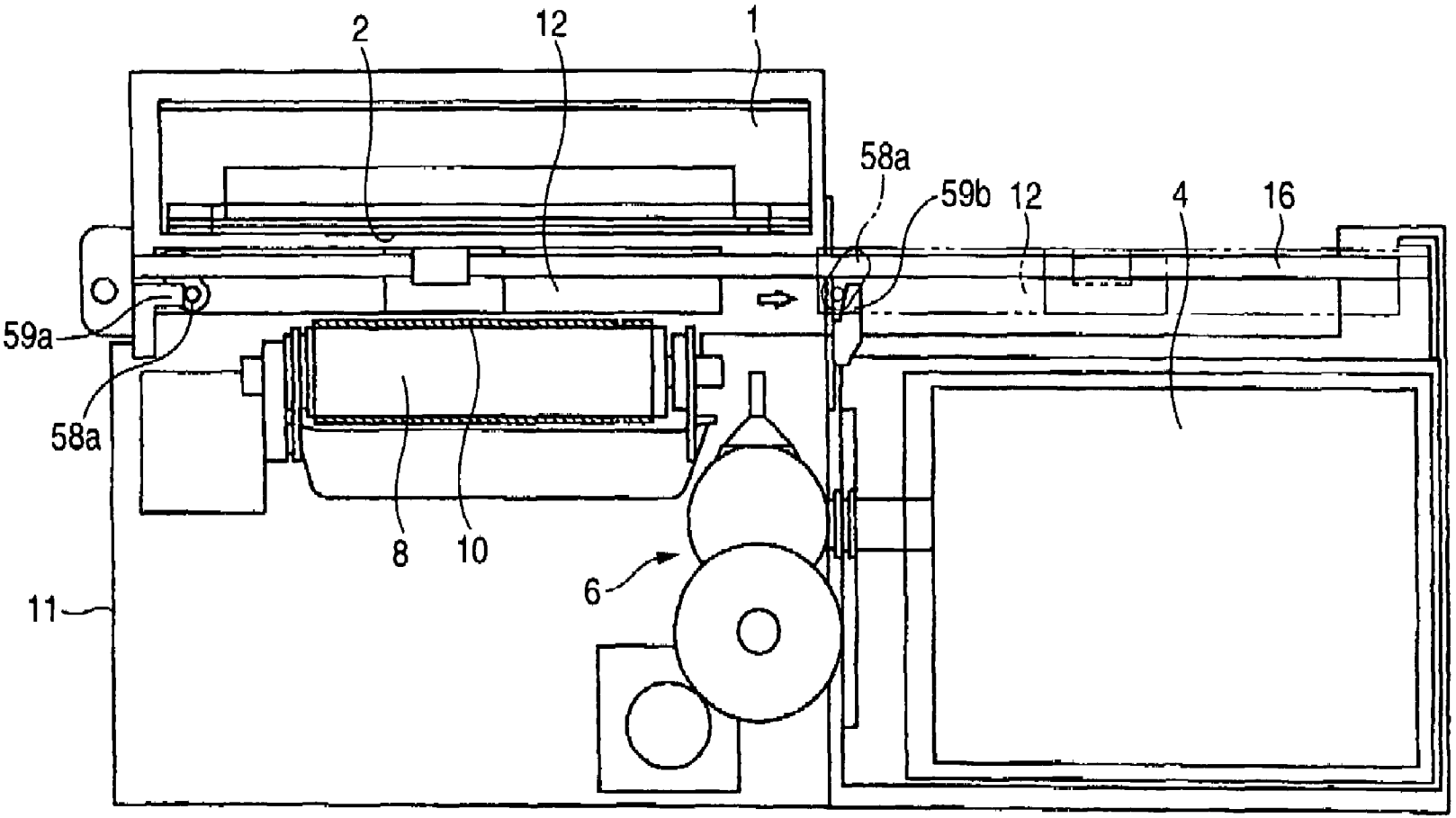
FIG. 1 is a configuration diagram of a printer using maintenance apparatus according to an embodiment of the invention, in which a mounting base is in a maintenance position.
Figure 2:
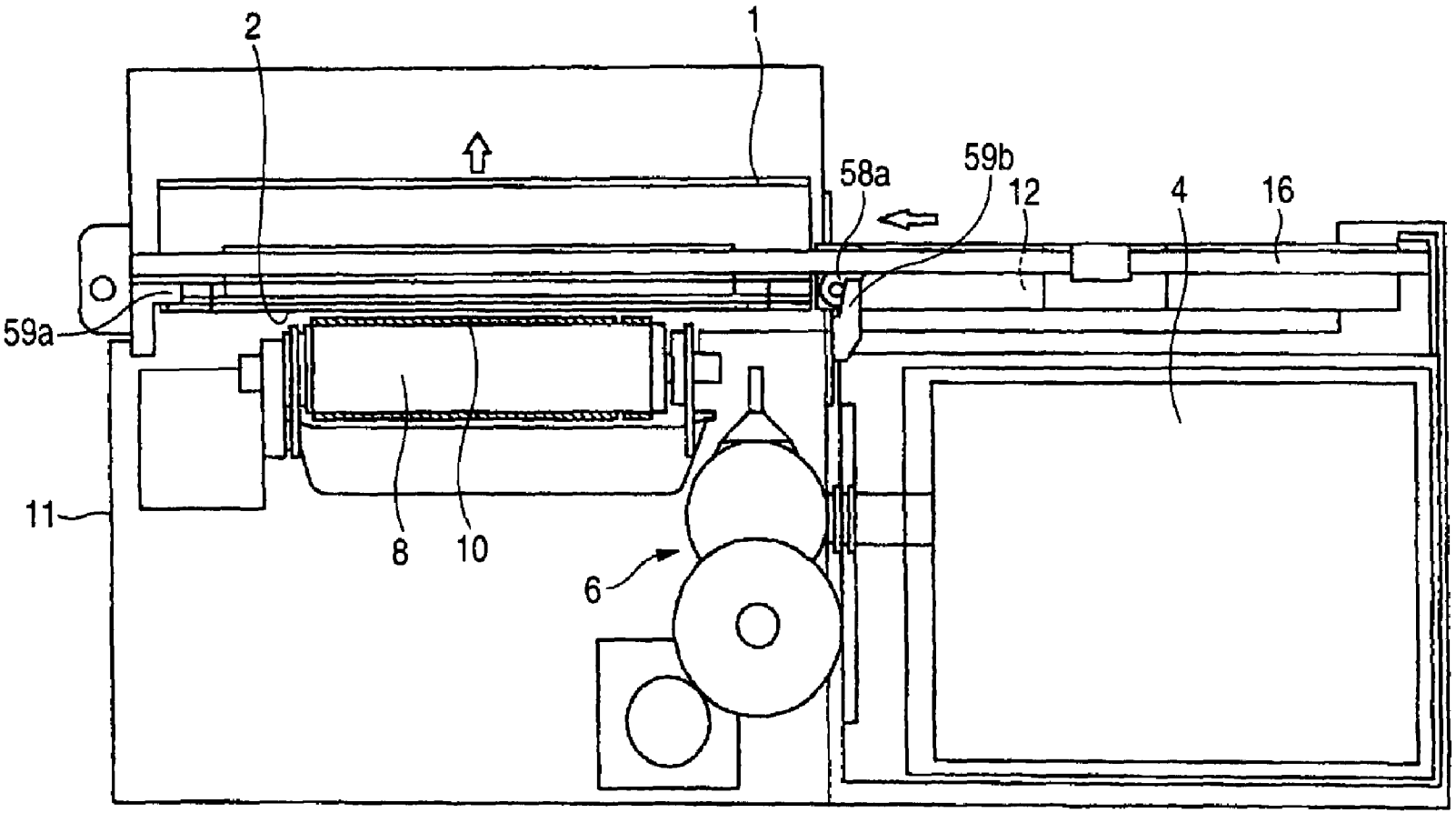
FIG. 2 is a configuration diagram of the printer using the maintenance apparatus according to the embodiment, in which the mounting base is in a retraction position.

As shown in FIGS. 1 and 2, a printer according to this embodiment has a full-line type print head 1, and a large number of not-shown nozzles are arrayed in the print head 1 in a direction perpendicular to the direction of feeding printing paper. A nozzle surface 2 in which the nozzles are opened is disposed to be opposed to the printing paper.

In addition, the print head 1 is of an ink jet system for ejecting ink droplets onto the printing paper. For example, such a print head 1 is provided for respective colors of yellow, magenta, cyan and black. Incidentally, each part of the print head 1 is supplied with its corresponding color ink from an ink cartridge 4 through an ink supply mechanism 6.

The printing paper is fed in tight contact with the surface of a belt 10 laid between a pair of rollers 8 (only one of which is shown). Each print head 1 is disposed in a body case 11 movably in a direction perpendicular to the surface of the belt 10 on which the paper is mounted. At the time of carrying out printing, the print head 1 is moved to an ink ejection position close to the printing paper as shown in FIG. 2. At the time of maintenance, the print head 1 is moved to a standby position in which a predetermined space is formed between the print head 1 and the printing paper and which is more distant from the belt 10 than the ink ejection position, as shown in FIG. 1.

Figure 3:
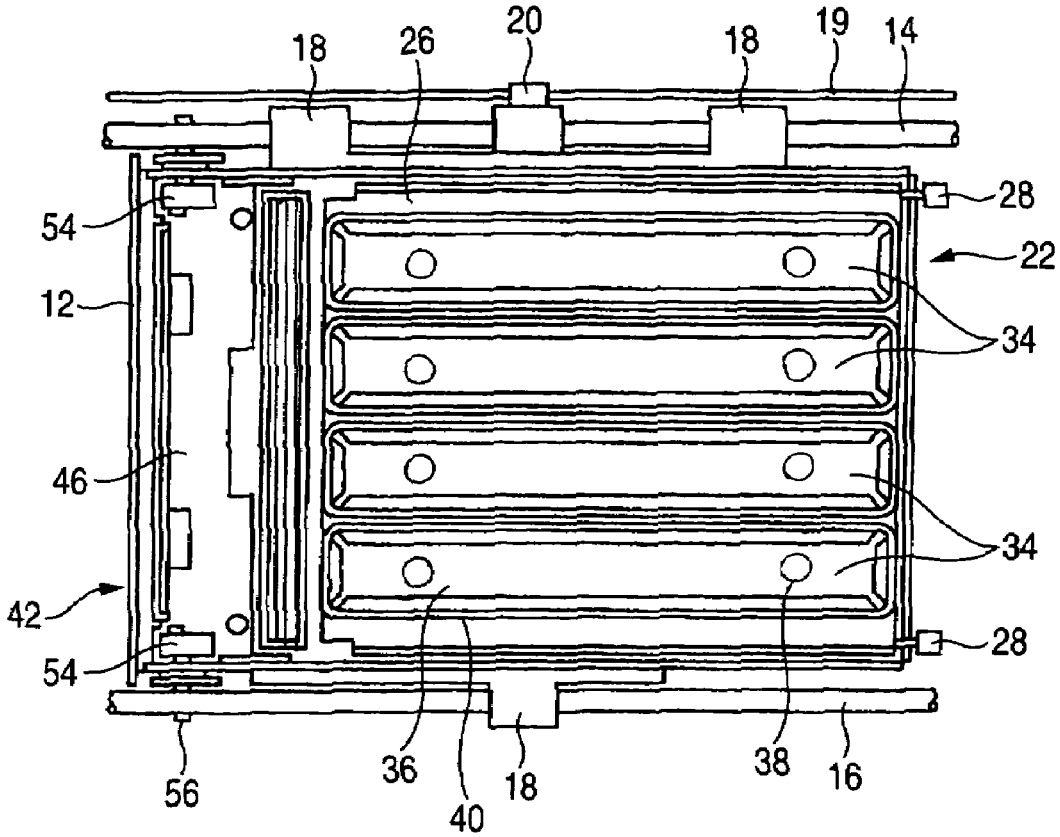
FIG. 3 is a plan view of the mounting base mounted with a capping mechanism and a wiping mechanism according to the embodiment.

A mounting base 12 which can be inserted into this space is provided. As shown in FIG. 3, the mounting base 12 is supported on a pair of guide bars 14 and 16 through a plurality of sliding members 18 so that the mounting base 12 can move forward/backward linearly. The guide bars 14 and 16 are disposed perpendicularly to the direction of feeding the printing paper (direction perpendicular to the paper surface of FIG. 1). A belt 19 is laid in parallel with the guide bars 14 and 16. The mounting base 12 and the belt 19 are fastened to each other through a lock member 20.

When the belt 19 is driven by a motor, the mounting base 12 slides along the guide bars 14 and 16 so that the mounting base 12 can move forward/backward between a maintenance position (position designated by the solid line in FIG. 1) in which the mounting base 12 is inserted into the space between the print headland the printing paper and a retraction position (position designated by the chain double-dashed line in FIG. 1 and position illustrated in FIG. 2) in which the mounting base 12 is retracted from the space to the upper side of the ink cartridge 4 at the time of printing.

Figure 4:
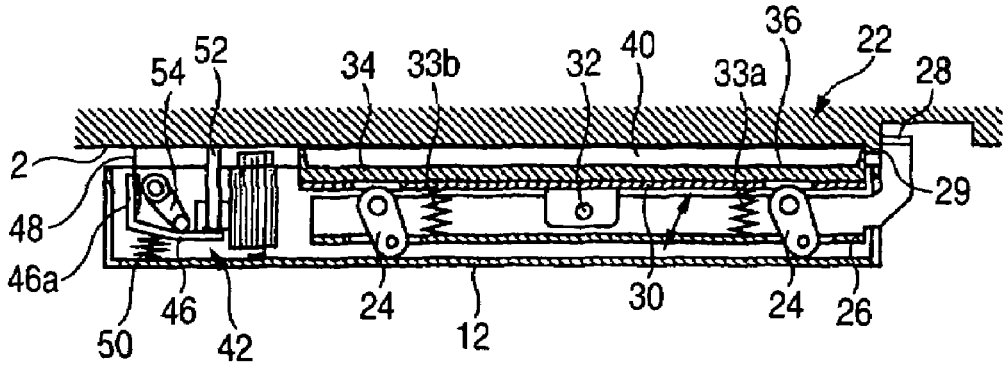
FIG. 4 is a sectional view of the mounting base mounted with a capping mechanism and a wiping mechanism according to the embodiment, in which the mounting base is in the maintenance position.
Figure 5:
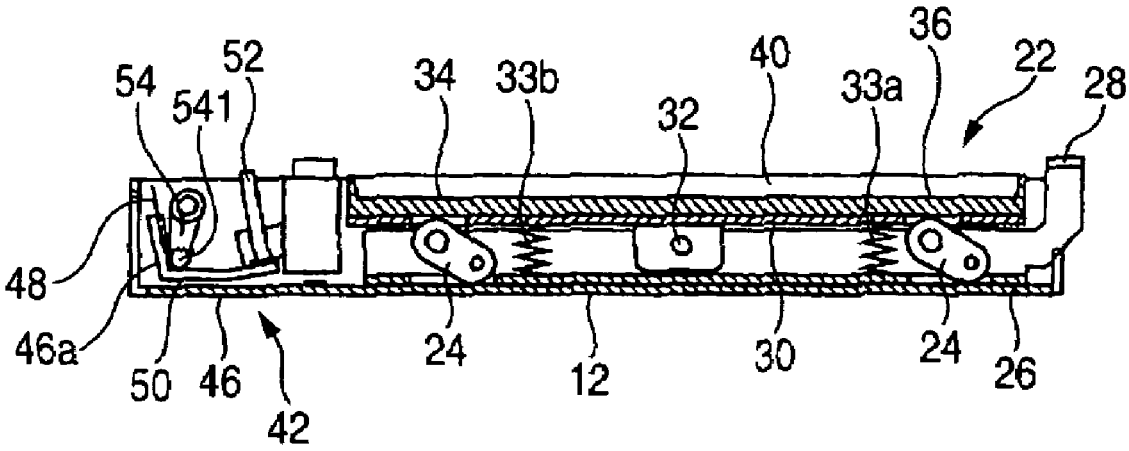
FIG. 5 is a sectional view of the mounting base mounted with the capping mechanism and the wiping mechanism according to the embodiment, in which the mounting base is in the retraction position.

A capping mechanism 22 is mounted on the mounting base 12. The capping mechanism 22 has a plurality of links 24 one ends of which are supported swingably on the mounting base 12, and a cap base 26 on which the other ends of the links 24 are supported swingably. The cap base 26 is designed to swing due to its own weight in a direction in which the mounting base 12 moves forward to the maintenance position, so as to leave the nozzle surface 2 and come into contact with the mounting base 12, as shown in FIGS. 4 and 5. Incidentally, the cap base 26 may be designed to leave the nozzle surface 2 by means of an urging member instead of its own weight.

On the cap base 26, each engagement portion 28 integrated with the cap base 26 is formed to protrude toward the nozzle surface 2. On the print head 1, each lock member 29 as a fixed side is formed to protrude from the nozzle surface 2. When the mounting base 12 is moved forward to the maintenance position, the engagement portion 28 abuts against the lock portion 29 near the forward end to thereby move the cap base 26 toward the nozzle surface 2 so as to describe an arc while keeping the cap base 26 parallel with the nozzle surface 2.

On the cap base 26, a swinging base 30 is supported swingably around a pin 32. Coil springs 33*a* and 33*b* are disposed on the opposite sides of the pin 32 and between the cap base 26 and the swinging base 30. Correspondingly to the respective colors of the print head 1, in this embodiment, four caps 34 are attached to the swinging base 30. Each cap 34 is made of an elastically deformable material, and particularly formed out of a material resistant against ink, such as butyl rubber or EPDM.

A bottom surface 36 opposed to the nozzle surface 2 is formed in the cap 34 as shown in FIG. 3. The bottom surface 36 is substantially flat, and an exhaust hole 38 opened in the bottom surface 36 is formed in the cap 34. The exhaust hole 38 is designed to be connected to a not-shown exhaust duct so as to be able to exhaust ink. In the cap 34, a lip piece 40 is provided to surround the bottom surface 36. The lip piece 40 protrudes toward the nozzle surface 2 of the print head 1.

Figure 6A:
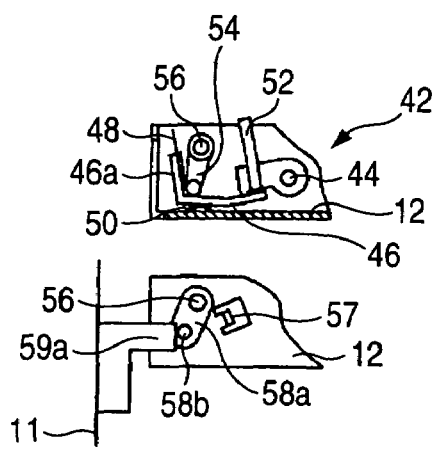
FIGS. 6A to 6C are explanatory views for explaining the operation of the wiping mechanism at a forward end according to the embodiment.
Figure 6B:
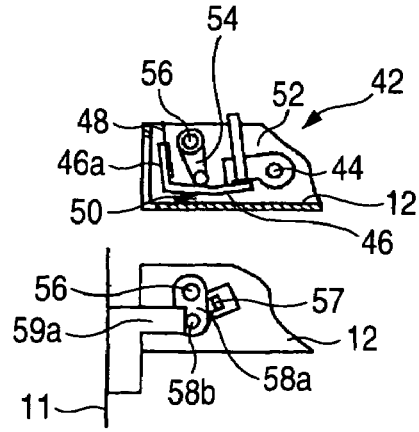
Figure 6C:
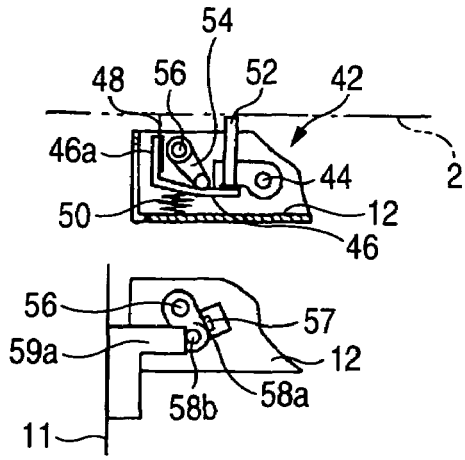

A wiping mechanism 42 is also mounted on the mounting base 12. As shown in FIGS. 6A-6C, the wiping mechanism 42 has a wiper base 46 supported on the mounting base 12 swingably around a fulcrum pin 44. The wiper base 46 has a support portion 46*a* provided erectly toward the nozzle surface 2. A wiper 48 is attached to the support portion 46*a*. In addition, an urging member 50 using a coil spring is disposed between the wiper base 46 and the mounting base 12, so as to swing the wiper base 46 around the fulcrum pin 44 and thereby urge the wiper 48 toward the nozzle surface 2.

An abutment pin 52 is provided erectly on the wiper base 46. As shown in FIG. 4, the abutment pin 52 is formed to be high enough to abut at its front end against the nozzle surface 2 to thereby regulate the swinging of the wiper base 46 when the wiper base 46 is swung. In such a state where the swinging of the wiper base 46 is regulated, the wiper 48 is brought into contact with the nozzle surface 2 by moderate force.

On the mounting base 12, a lever 54 is supported swingably around a fulcrum pin 56. The lever 54 is designed as follows. That is, when the lever 54 swings around the fulcrum pin 56, the lever 54 abuts at its front end against the wiper base 46 so as to swing the wiper base 46 against the urging force of the urging member 50, and thereby push down the wiper base 46 in a direction to leave the nozzle surface 2, as shown in FIG. 5.

When the front end of the lever 54 abuts against the support portion 46*a*, the lever 54 is located beyond a line passing through the center of the fulcrum pin 56 and perpendicular to the nozzle surface 2, and on the opposite side with respect to the line (the left side in FIGS. 6A-6C with respect to the line). However, the further swinging is regulated because the lever 54 abuts against the support portion 46*a*.

The fulcrum pin 56 protrudes outside the mounting base 12. A swinging arm 58*a* is integrally attached to the fulcrum pin 56. A pin 58*b* parallel with the fulcrum pin 56 is provided erectly on the swinging arm 58*a*. To the body case 11, a forward-side protrusion 59*a* is attached as a fixed side with which the pin 58*b* comes into contact when the mounting base 12 reaches the forward end.

When the pin 58*b* abuts against the forward-side protrusion 59*a*, the lever 54 is swung through the swinging arm 58*a* and the fulcrum pin 56. Thus, the lever 54 is swung in a direction to leave the support portion 46*a* so as to be located beyond the perpendicular line and on the opposite side with respect to the perpendicular line (the right side in FIGS. 6A-6C with respect to the perpendicular line). As shown in FIG. 6C, the wiper base 46 is swung around the fulcrum pin 44 by the urging force of the urging member 50 so that the wiper 48 is swung to be located in the wiping position where the wiper 48 is brought into contact with the nozzle surface 2. Incidentally, in this embodiment, when the wiper 48 is located in the wiping position, the swinging arm 58*a* abuts against a stopper 57 so as to prevent the wiper 48 from swinging further.

In addition, to the body case 11, a backward-side protrusion 59*b* is attached as a fixed side with which the pin 58*b* comes into contact at the backward end when the mounting base 12 is moved backward to the retraction position. The backward-side protrusion 59*b* is designed as follows. That is, when the mounting base 12 moves to the backward end, the pin 58*b* abuts against the backward-side protrusion 59*b* so as to swing the lever 54 through the swinging arm 58*a* and the fulcrum pin 56. Thus, the lever 54 is swung in a direction to contact with the support portion 46*a* so as to be located beyond the perpendicular line and on the opposite side with respect to the perpendicular line. As a result, the wiper base 46 is swung to swing the wiper 48 to the separation position where the wiper 48 has left the nozzle surface 2, as shown in FIG. 7C.

Next, description will be made on the operation of the printer maintenance apparatus according to this embodiment.

At the time of printing, the belt 10 is driven by the rotations of the rollers 8 so that printing paper passes under the print head 1 at a fixed speed. Then, ink droplets are ejected from the print head 1 so that printing is performed line by line.

At the time of maintenance for recovering the nozzles of the print head 1 from clogging or for cleaning the nozzles of the print head 1, the print head 1 is moved from the ink ejection position shown in FIG. 2 to the standby position shown in FIG. 1, in a direction to leave the printing paper, by a head vertical motion motor. Thus, a predetermined space is formed. Then, driven by the belt 19, the mounting base 12 is guided along the guide bars 14 and 16 and moved from the retraction position to the maintenance position where the mounting base 12 is inserted into the space under the print head 1.

At the time of forward motion in which the mounting base 12 moves from the retraction position to the maintenance position, when the mounting base 12 reaches the vicinity of the forward end, each engagement portion 28 abuts against each lock portion 29. Further, when the mounting base 12 reaches the forward end, the plurality of links 24 swing to move the cap base 26 toward the nozzle surface 2 so as to describe an arc while retaining the cap base 26 parallel with the nozzle surface 2.

As a result, the cap 34 is pressed onto the nozzle surface 2. In that event, the swinging base 30 equalizes the cap 34 around the pin 32 so as to press the cap 34 onto the nozzle surface 2 with uniform pressing force. In the state where each engagement portion 28 is brought into abutment against each lock portion 29, the state where the nozzle surface 2 is covered with the cap 34 is retained.

On the other hand, similarly, at the time of forward motion in which the mounting base 12 moves from the retraction position to the maintenance position, when the mounting base 12 reaches the vicinity of the forward end, the pin 58*b* abuts against the forward-side protrusion 59*a* so as to swing the lever 54 through the swinging arm 58*a* and the fulcrum pin 56 as shown in FIG. 6A. When the mounting base 12 is further moved toward the forward end, the lever 54 swings in a direction to leave the support portion 46*a* so as to be located beyond the perpendicular line and on the opposite side with respect to the perpendicular line as shown in FIG. 6B. When the mounting base 12 reaches the forward end, the wiper base 46 is swung around the fulcrum pin 44 by the urging force of the urging member 50 as shown in FIG. 6C. Thus, the wiper 48 is moved to the wiping position where the wiper 48 is brought into contact with the nozzle surface 2.

Then, ink droplets are ejected from the nozzles so as to solve clogging or the like. Thus, recovery processing is performed. When printing is to be performed after the recovery processing is terminated, the mounting base 12 is moved backward from the maintenance position to the retraction position. When the mounting base 12 leaves the maintenance position, the pin 58*b* leaves the forward-side protrusion 59*a*. However, the wiper base 46 is urged by the urging member 50 so as to be located in the position where the wiper base 46 is regulated by the stopper 57. Thus, the front end of the wiper 48 keeps contacting with the nozzle surface 2. Under such a condition, the wiper 48 moves toward the retraction position while wiping and cleaning the nozzle surface 2. Incidentally, once the recovery processing (purge) is performed, the mounting base 12 is preferably retracted from the maintenance position immediately after the purge so as to perform cleaning with the wiper 48. It is because the recovery performance would be lower if the time for ink to adhere to the nozzle surface 2 were longer.

In addition, when the mounting base 12 moves backward from the maintenance position, the engagement portion 28 leaves the lock portion 29. As a result, the plurality of links 24 swing to allow the cap base 26 to fall due to its own weight. Thus, the cap 34 leaves the nozzle surface 2, and the cap base 26 comes into contact with the mounting base 12 as shown in FIG. 5. Although the cap base 26 falls due to its own weight here, the cap base 26 may be urged in a direction to leave the nozzle surface 2 by an urging member such as a tension spring provided between the cap base 26 and the mounting base 12. Thus, the cap base 26 can be moved down surely.

Figure 7A:
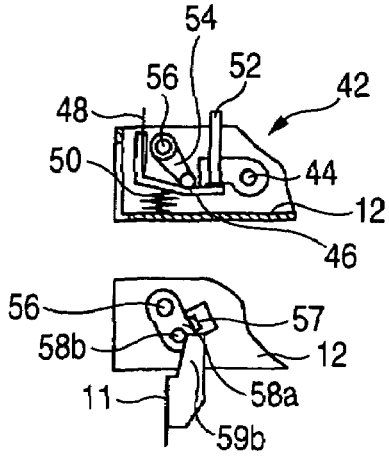
FIGS. 7A to 7C are explanatory views for explaining the operation of the wiping mechanism at a backward end according to the embodiment.
Figure 7B:
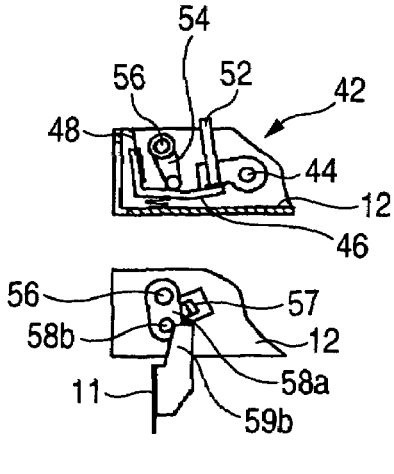
Figure 7C:
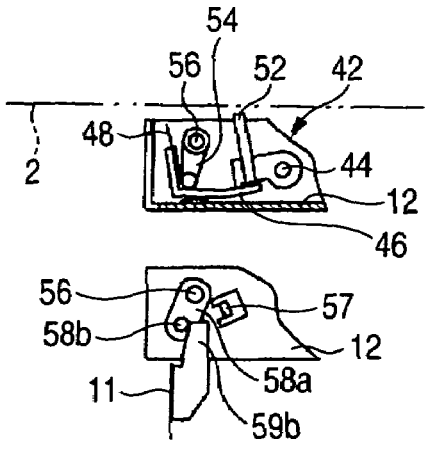

When the wiper 48 cleans the nozzle surface 2 and the mounting base 12 reaches the vicinity of the backward end, the pin 58*b* comes into contact with the backward-side protrusion 59*b* as shown in FIG. 7A. When the mounting base 12 is further moved toward the backward end, the lever 54 is swung against the urging force of the urging member 50 through the swinging arm 58*a* and the fulcrum pin 56. Thus, the lever 54 is swung in a direction to come into contact with the support portion 46*a* so as to be located beyond the perpendicular line and on the opposite side with respect to the perpendicular line as shown in FIG. 7B. As soon as the lever 54 goes beyond the perpendicular line, the wiper base 46 is urged by the urging force of the urging member 50 in a direction to protrude the wiper 48 again. However, a pin 541 at the front end of the lever 54 contacts with the support portion 46*a* so that the posture of the lever 54 is retained at that position. That is, when the mounting base 12 reaches the backward end, the wiper base 46 swings to swing the wiper 48 to the separation position where the wiper 48 is located at a distance from the nozzle surface 2, as shown in FIG. 7C. The wiper base 46 is retained in the separation position till the pin 58*b* leaves the backward-side protrusion 59*b* and is released by the forward-side protrusion 59*a*. In the retraction position where the mounting base 12 reaches the backward end, each of the wiper 48 and the cap 34 is at a lower level than the nozzle surface 2 as shown in FIG. 5.

In such a manner, the mounting base 12 performs forward/backward motion between the maintenance position and the retraction position so that the cap 34 and the wiper 48 are moved toward the nozzle surface 2 independently of each other. Then, by the forward motion of the mounting base 12, the cap 34 is pressed onto the nozzle surface 2, and the wiper 48 is brought into contact with the nozzle surface 2. Thus, capping and wiping can be attained with a simple structure. In addition, the nozzle surface 2 is cleaned with the wiper 48 during the backward motion of the mounting base 12 after recovery processing is performed with the nozzle surface 2 being covered with the cap 34. Therefore, ink and the like adhering to the nozzle surface 2 during the recovery processing can be cleaned up. Thus, wiping and capping can be performed at proper timing.

Figure 8A:
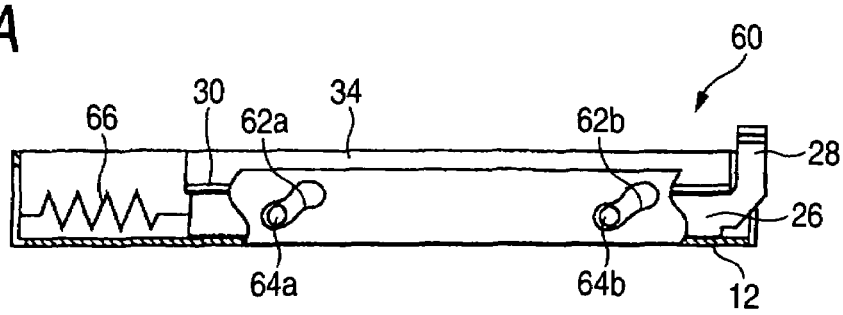
FIGS. 8A and 8B are explanatory, partially sectional views showing a mounting base mounting with a capping mechanism according to another embodiment.
Figure 8B:
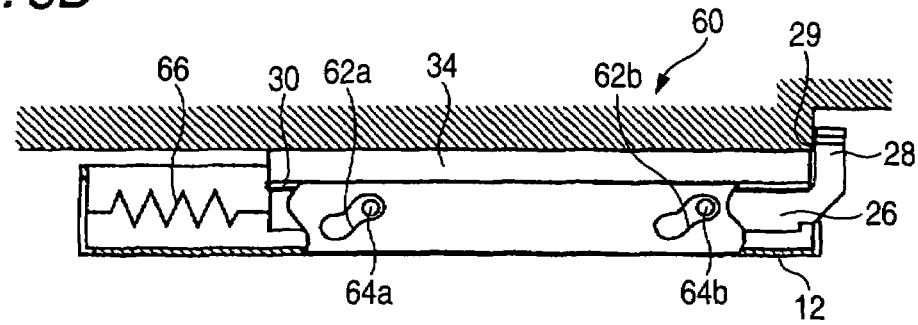

Next, description will be made on another capping mechanism 60 different from the aforementioned capping mechanism 22, with reference to FIGS. 8A and 8B. Incidentally, members the same as those in the aforementioned embodiment are denoted by the same reference numerals correspondingly, and their detailed description will be omitted. The same thing can be applied to the following drawings.

In this capping mechanism 60, cam grooves 62*a* and 62*b* are formed in the mounting base 12. Pins 64*a* and 64*b* attached to the cap base 26 are inserted to the cam grooves 62*a* and 62*b* so that the pins 64*a* and 64*b* can slide along the cam grooves 62*a* and 62*b*. The cam grooves 62*a* and 62*b* are formed to be inclined obliquely with respect to the direction of the forward/backward motion of the mounting base 12.

In addition, an urging member 66 using a coil spring is provided between the mounting base 12 and the cap base 26. As shown in FIG. 8A, the cap base 26 is moved along the cam grooves 62*a* and 62*b* by the pulling urge of the urging member 66, so as to allow the cap 34 to leave the nozzle surface 2. Then, when the mounting base 12 is moved forward and the engagement portion 28 abuts against the lock portion 29, the cap base 26 is moved toward the nozzle surface 2 against the urging force of the urging member 66, so as to press the cap 34 onto the nozzle surface 2. This embodiment using the capping mechanism 60 can be also carried out in the same manner as in the aforementioned embodiment.

Next, description will be made on another wiping mechanism 70 different from the wiping mechanism 42, with reference to FIGS. 9A and 9B.

Figure 9A:
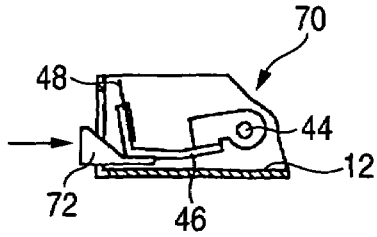
FIGS. 9A and 9B are explanatory views for explaining the operation of a wiping mechanism at forward and backward ends according to another embodiment.
Figure 9B:
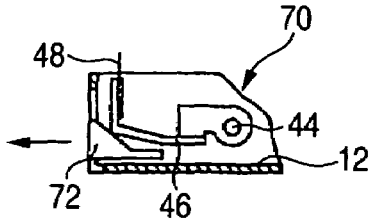

In this wiping mechanism 70, as shown in FIG. 9A, an inclined cam 72 is inserted to the lower side of the wiper base 46 so as to swing the wiper base 46 toward the nozzle surface 2. The inclined cam 72 is supported slidably on the mounting base 12. When the mounting base 12 reaches the forward end, the inclined cam 72 abuts against the body case 11 and is inserted to the lower side of the wiper base 46 so as to swing the wiper 48 to the wiping position, as shown in FIG. 9B.

On the other hand, when the mounting base 12 reaches the backward end, the inclined cam 72 abuts against a not-shown protrusion formed on the body case 11 so as to be extracted from the wiper base 46. Thus, when the mounting base 12 reaches the backward end, the wiper 48 is swung to the retraction position as shown in FIG. 9A. This embodiment using the wiping mechanism 70 can be also carried out in the same manner as in the aforementioned embodiment.

The invention is not limited to such embodiments at all, but it can be carried out in various forms without departing from the spirit and scope of the invention.

As described above in detail, in printer maintenance apparatus according to the embodiments, the mounting base 12 moves forward/backward between a maintenance position and a retraction position so that the cap 34 and the wiper 48 are moved toward the nozzle surface 2 independently of each other. By the forward motion of the mounting base 12, the cap 34 is pressed onto the nozzle surface 2, and the wiper 48 is brought into contact with the nozzle surface 2. Thus, capping and wiping can be attained with a simple structure. On the other hand, when the mounting base 12 is moved backward after recovery processing is performed, the nozzle surface 2 is cleaned with the wiper. Thus, ink and the like adhering to the nozzle surface 2 during the recovery processing can be cleaned up. Accordingly, there is an advantage that wiping and capping can be performed at proper timing.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. A printer maintenance apparatus for maintaining a printer having a print head, wherein the print head includes a nozzle surface in which a plurality of nozzles are formed, for ejecting ink droplets onto fed printing medium for printing, the apparatus comprising:

a mounting base that is movable forward and backward between a maintenance position and a retraction position, the maintenance position in which the mounting base is opposed to the nozzle surface and the retraction position in which the mounting base is retracted from the print head;

a wiping mechanism being mounted on the mounting base and including a wiper base supported on the mounting base movably toward the nozzle surface and a wiper attached to the wiper base; and a capping mechanism being mounted on the mounting base and including a cap base supported on the mounting base movably toward the nozzle surface and a cap attached to the cap base;

wherein the cap base moves toward the nozzle surface to move the cap to cover the nozzle surface when the mounting base is at the maintenance position;

the cap base moves retractably from the nozzle surface when the mounting base moves from the maintenance position toward the retraction position;

the wiper base moves toward the nozzle surface relative to the mounting base in order to bring the wiper into contact with the nozzle surface when the mounting base is at the maintenance position; and the wiper base keeps the wiper in contact with the nozzle surface while the mounting base moves backward from the maintenance position toward the retraction position.

2. The printer maintenance apparatus according to claim 1, wherein the cap base has an engagement portion which abuts against a fixed portion disposed in the printer, at a forward end of the maintenance position due to a forward motion of the mounting base to the maintenance position, to thereby move the cap base toward the nozzle surface and cover the nozzle surface with the cap.

3. The printer maintenance apparatus according to claim 1, wherein the wiper base abuts against a fixed portion which abuts against a fixed portion disposed in the printer, at the maintenance portion due to a forward motion of the mounting base to the maintenance position, to thereby move the wiper toward the nozzle surface and bring the wiper into contact with the nozzle surface.

4. The printer maintenance apparatus according to claim 1, wherein the capping mechanism includes a plurality of link members each supported swingably at one end on the mounting base and supported swingably at the other end on the cap base.

5. The printer maintenance apparatus according to claim 1, wherein the capping mechanism includes a cam groove inclined to the nozzle surface and a pin slidable in the cam groove, and one of the cam groove and the pin is provided in the mounting base while the other is provided in the cap base.

6. The printer maintenance apparatus according to claim 1, wherein the capping mechanism allows the cap to leave the nozzle surface due to self-weight of the cap base in backward motion of the mounting base from the maintenance position to the retraction position.

7. The printer maintenance apparatus according to claim 1, wherein the capping mechanism includes an urging member that urges the cap to leave the nozzle surface.

8. The printer maintenance apparatus according to claim 1, wherein the wiping mechanism supports the wiper base swingably on the mounting base; and the wiping mechanism includes an urging member that swings the wiper base to bring the wiper into contact with the nozzle surface.

9. The printer maintenance apparatus according to claim 8, wherein the wiping mechanism includes a lever supported swingably on the mounting base;

the lever is swingable between a separation position and a wiping position, the separation position where the lever abuts against the wiper base to thereby swing the wiper base against urging of the urging member and make the wiper leave the nozzle surface, the wiping position where the lever brings the wiper into contact with the nozzle surface; and the lever is swung to the wiping position at a forward end due to a forward motion of the mounting base to the maintenance position.

10. The printer maintenance apparatus according to claim 9, wherein the wiping mechanism swings the lever to the separation position at a backward end due to a backward motion of the mounting base.

11. The printer maintenance apparatus according to claim 1, wherein the wiping mechanism supports the wiper base shiftably on the mounting base;

the wiping mechanism includes an urging member that urges the wiper base to leave the nozzle surface;

the wiping mechanism brings the wiper into contact with the nozzle surface due to a forward motion of the mounting base to the maintenance position; and the wiping mechanism shifts the wiper base by means of the urging member so as to make the wiper leave the nozzle surface.

12. A printer comprising:

a print head including a nozzle surface that ejects ink droplets onto fed printing medium;

a mounting base that is movable forward and backward between a maintenance position and a retraction position, the maintenance position in which the mounting base is opposed to the nozzle surface and the retraction position in which the mounting base is retracted from the print head;

a wiping mechanism being mounted on the mounting base and including a wiper base supported on the mounting base movably toward the nozzle surface and a wiper attached to the wiper base; and a capping mechanism being mounted on the mounting base and including a cap base supported on the mounting base movably toward the nozzle surface and a cap attached to the cap base;

wherein the cap base moves toward the nozzle surface to move the cap to cover the nozzle surface when the mounting base is at the maintenance position;

the cap base moves retractably from the nozzle surface when the mounting base moves from the maintenance position toward the retraction position;

the wiper base moves toward the nozzle surface relative to the mounting base in order to bring the wiper into contact with the nozzle surface when the mounting base is at the maintenance position; and the wiper base keeps the wiper in contact with the nozzle surface while the mounting base moves backward from the maintenance position toward the retraction position.

13. The printer according to claim 12, further comprising:

a fixed portion;

wherein the cap base has an engagement portion which abuts against the fixed portion at a forward end of the maintenance position due to a forward motion of the mounting base to the maintenance position, to thereby move the cap base toward the nozzle surface and cover the nozzle surface with the cap.

14. The printer according to claim 13, wherein the fixed portion is a lock portion that is disposed at the print head.

15. The printer maintenance apparatus according to claim 1, wherein the wiper base is vertically movable relative to the mounting base.

16. The printer according to claim 12, wherein the wiper base is vertically movable relative to the mounting base.

17. The printer maintenance apparatus according to claim 1, wherein the wiper base keeps the wiper spaced from the nozzle surface while the mounting base moves forward from the retraction position toward the maintenance position.

18. The printer according to claim 12, wherein the wiper base keeps the wiper spaced from the nozzle surface while the mounting base moves forward from the retraction position toward the maintenance position.

* * * * *